United States Patent [19]

Comito

[11] Patent Number: 4,795,121

[45] Date of Patent: Jan. 3, 1989

[54] WINDOW FRAME LIGHT HANGER

[76] Inventor: Charles Comito, 31459 Meadows, Madison Hgts., Mich. 48071

[21] Appl. No.: 93,590

[22] Filed: Sep. 4, 1987

[51] Int. Cl.[4] ..... A47F 5/00

[52] U.S. Cl. ..... 248/314; 211/26; 211/70.1; 211/89; 248/300; 248/316.7; 248/DIG. 9; 248/DIG. 11; 248/DIG. 12; 362/382; 362/806; D26/25; D26/138

[58] Field of Search ..... 248/65, 314, 328, 74.2, 248/67.7, 315, 316.7, DIG. 9, DIG. 11, DIG. 12, 51, 300, 308; D13/25; D26/25, 138; 362/806, 382, 391, 392, 396, 810, 249, 252; 211/70.6, 70.1, 26, 89

[56] References Cited

U.S. PATENT DOCUMENTS

| | | | |
|---|---|---|---|
| 808,354 | 12/1905 | Elliott | 248/254 |
| 2,648,152 | 8/1953 | Simpson | 248/300 X |
| 2,722,317 | 11/1955 | Goodwin | 211/89 |
| 3,275,818 | 9/1966 | Campbell | 362/249 |
| 4,244,014 | 1/1981 | Van Ess | 362/249 |
| 4,357,653 | 11/1982 | Kovacs | 362/806 X |
| 4,588,153 | 5/1986 | Boston et al. | 248/74.2 |

FOREIGN PATENT DOCUMENTS

| | | | |
|---|---|---|---|
| 27564 | 3/1955 | Finland | 248/DIG. 9 |

*Primary Examiner*—Alvin C. Chin-Shue
*Assistant Examiner*—David L. Talbott
*Attorney, Agent, or Firm*—Leon Gilden

[57] ABSTRACT

An improved light hanger apparatus is set forth framed of a generally "L" shaped configuration. Tapered keyhole shaped bores within said hanger enable secure positioning of Christmas-type lights therein with the keyhole slot configuration enabling the feeding of adjoining wires to said lights to be fed therethrough enabling successive positioning of such lights with the improved apparatus. Nail holes are positioned in alternating succession to said keyhole openings enabling securement to window sill structure. The legs of the "L" shpaed bracket are in an approximately two to one ratio wherein the short leg when secued to an interior window framework enables the long leg to project beyond the window frame itself and alternately the long leg may be secured to a support surface when the improved light hanger apparatus is positioned exeriorly of a window. Perforations are used in preset gradations to enable manual separation of the improved window frame light hanger apparatus along according to need.

5 Claims, 1 Drawing Sheet

WINDOW FRAME LIGHT HANGER

BACKGROUND OF THE INVENTION

1. Field of the Invention

The present invention relates to light positioning apparatus and particularly to a new and improved light positioning hanger that enables projection of secured Christmas-type lights beyond the normal window framework enabling desired viewing thereof.

2. Description of the Prior Art

The securing of Christmas-type lights is well known. As may be appreciated under normal circumstances, these lights are taped or nailed by other relatively crude means about a window framework to provide viewing thereof. While bracketry of various sorts is well known, it may be appreciated that there has heretofore been development an apparatus enabling relatively easy securement of lights thereto enabling desired positioning of such lights about a window framework. For example, U.S. Pat. No. 1,261,513 to Green sets forth a bracketry configured and arranged to enable positioning of various window accessory items relative to a window frame. Such items may include flower boxes and the like. While presenting relatively useful bracketry for enabling securement to a window sill and the like, the invention falls short in providing any illumination holding means and particularly light holding means to frame a window for seasonal decorative purposes and their unique requirements to be oriented relative to the transparent window pane portion of a window.

U.S. Pat. No. 1,355,322 to Feeney sets forth a window frame secured bracket particularly utilized for the support of a flag pole-like arrangement for display purposes. The relatively complex structure as compared to the instant invention fails to provide any means of positioning lights or any other series of elements about a window frame in a serial-like manner, as set forth by my invention.

U.S. Pat. No. 1,652,825 to Hechinger presents a window lamp display frame for positioning lamps in an arcuate manner relative to a window. While of an improved lamp display construction, the bracketry tails to provide means for positioning lamps about the perimeter of a window frame and more particularly fails to set forth any means of height positioning relative to variations in window frame design.

It may therefore by appreciated that there is continuing need for a new and improved window frame light hanger arrangement which addresses both the problem of positioning and adapatability to window frames of varying lengths and configurations, and in this respect, the present invention substantially fulfills this need.

SUMMARY OF THE INVENTION

In view of the foregoing disadvantages inherent in the known types of window frame light hanger now present in the prior art, the present invention provides an window frame light hanger of generally "L" shaped configuration to enable selective positioning about a window frame to permit visibility of associated lights. As such, the general purpose of the present invention, which will be described subsequently in greater detail, is to provide a new and improved window frame light hanger which has all the advantages of the prior art window frame light hangers and none of the disadvantages.

To attain this, the present invention comprises a window frame light hanger which is configured of generally "L" shaped construction accepting positioning of lights upon either leg of said "L" configuration. Keyhole configuration of associated light accepting sockets permits threading of wires therethrough for ease of light socket positioning therein. Additionally, the invention has formed therein pre-formed perforations to permit manual separation of a length of the light hanger to adapt same to dimensional variations between windows that my invention is to be associated with. Finally, apertures are positioned in an alternating relationship to said keyhole shaped light socket openings to permit securement of said window frame light hanger, as desired.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will for the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved window frame light hanger which has all the advantages of the prior art window frame light hangers and none of the disadvantages.

It is another object of the present invention to provide a new and improved window frame light hanger which may be easily and efficiently manufactured and marketed.

It is a further object of the present invention to provide a new and improved window frame light hanger which is of a durable and reliable construction.

An even further object of the present invention is to provide a new and improved window frame light hanger which is susceptible of a low cost of manufacture with regard to both materials and labor, and which accordingly is then susceptible of low prices of sale to the consuming public, thereby making such window frame light hangers economically available to the buying public.

Still yet another object of the present invention is to provide a new and improved window frame light hanger which provides in the apparatuses and methods of the prior art some of the advantages thereof, while simultaneously overcoming some of the disadvantages normally associated therewith.

Still another object of the present invention is to provide a new and improved window frame light hanger of a generally "L" shaped configuration wherein one leg of said "L" is approximately twice the length of the other leg.

Yet another object of the present invention is to provide a new and improved window frame light hanger wherein key hole tapered sockets are positioned therealong to permit securement of Christmas-type lights normally wired together in a series.

Even still another object of the present invention is to provide a new and improved window frame light hanger to be perforated at pre-selected gradations to enable manual separation of said window frame light hanger at pre-selected lengths.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
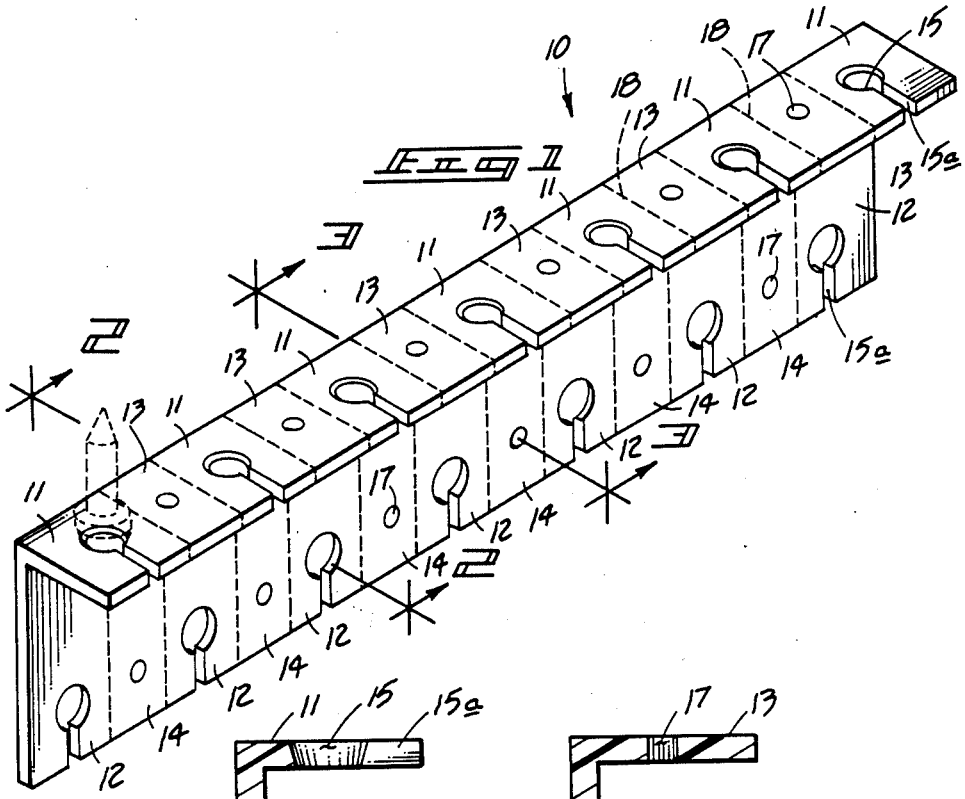
FIG. 1 is an isometric view of the present invention illustrating its various parts and their relationship.

With reference now to the drawings, and in particular to FIG. 1 thereof, a new and improved window frame light hanger embodying the principles and concepts of the present invention and generally designated by the reference numeral 10 will be described.

More specifically, it will be noted that the window frame hanger apparatus 10 essentially comprises an "L" shaped elongate strip formed With a first short leg 11 and a second long leg 12. Advantageously, it has been determined that long leg 12 should be formed of a length of approximately twice that of short leg 11 for purposes best illustrated below. Formed within both legs 11 and 12 are key hole openings 15 for acceptance of Christmas-type lights and their associated sockets within key hole openings 15.

Figure 2:
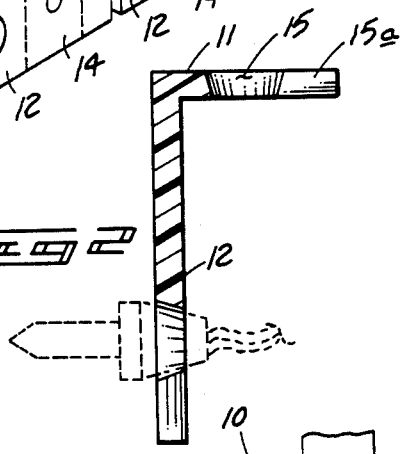
FIG. 2 is an orthographic side view of the present invention taken along the lines 2—2 of FIG. 1 in the direction indicated by the arrows.
Figure 3:
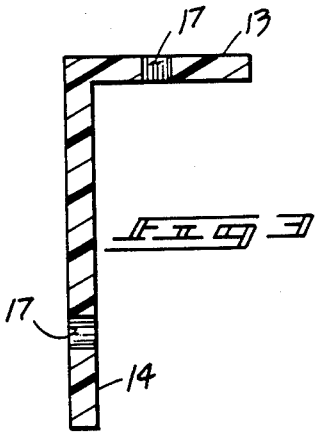
FIG. 3 is an orthographic side view of the present invention taken along the lines 3—3 of FIG. 1 in the direction indicated by the arrows.

With particular reference to FIG. 2, it will noted that key hole openings 15 are formed of tapered configuration, as indicated at 16, with said openings tapered toward the smaller diameter oriented inwardly of said "L" shaped configuration. Channel portion 15*a* leading into said tapered openings is directed towards the terminal end of either leg 11 and 12. Alternating legs 13 and 14 oriented along window frame light hanger 10 are formed with securement holes 17 for acceptance of various types of securement elements, such as screws and nails, etc.

Formed between respective sections containing key hole openings 15 and securement holes 17 are pre-perforated separation lines 18 extending orthogonally to the linear length of window frame light hanger 10. The pre-perforated lines 18 enable selective manual separation of lengths of said window frame light hanger 10 to accommodate linear dimensions among window frames. For example, should a portion of a window frame light hanger 10 be positionable within window frame opening and be it necessary to remove a portion thereof to enable positioning of said invention within a window frame opening, a user may merely manually grasp window frame light hanger 10 on either side a preperforated line 18 and separate said running length of the invention without the need for extraneous tool such as saws, etc., the window frame light hanger 10 is thereby immediately available for use.

In use, typical Christmas-type lights are formed with tapered sockets and said sockets are, as may be expected, are of slight varying dimensions dependent upon manufacturer and time of manufacture and dimension whereby tapered key hole openings 15 accommodate a wide variety of said sockets and securably nest them in openings 15. Channel portions 15*a* enable associated wires of said Christmas-type lights to be threaded in channel portions 15*a* such that the lights may be secured to said window frame light hanger 10 without separation of sockets from wiring.

Figure 4:
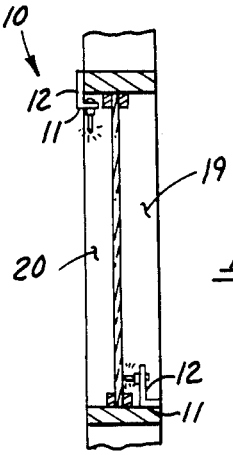
FIG. 4 is an orthographic side view of a typical window cross-section with the instant invention positioned both within and without the window relative to an interior of a dwelling.

In a typical application, as illustrated in FIG. 4, window frame light hanger 10 is secured relative to a window at the interior of a dwelling 19 where the short leg 11 is attached to the window sill enabling projection of longer leg 12 beyond the sill and allow said Christmas-type lights to be admissible both within and without the dwelling. Should such lights be desirable to be positioned at the exterior of such a window, as indicated at 20, long leg 12 is secured to the structure enabling short leg 11 to depend inwardly sheltered from climactic conditions such as rain and snow while again maintaining visibility of associated Christmas-type lights, both within and without a dwelling.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window frame light hanger device for use in association with tapered sockets, miniature-type lights comprising, a generally "L" shaped elongate strip including an elongate leg portion of a finite length orthogonal to and coextensively formed to a second elongate leg portion of equal finite length, and a series of keyhole shaped openings formed in said first and second leg portions for acceptance of said light, and a series of securement means formed in said light hanger in alternating relationship to said keyhole shaped openings, and said keyhole shaped openings are formed with tapered bores inwardly directed of said "L" shaped elongate strip for complementary acceptance of said sockets, and said securement means and key hole shaped openings formed in said first leg are in an aligned orthogonal relationship to said key hole shaped openings and securement means formed in said second leg.

2. A window frame device as set forth in claim 1 wherein said tapered inwardly directed bores have associated channel portions directed towards terminal portions of said first and second light portions.

3. A window frame light hanger device as set forth in claim 1 wherein said first light portion is substantially twice the length of said second leg portion.

4. A window frame light hanger device as set forth in claim 1 wherein said secure means are formed as bores in aligned relationship to said key hole shaped openings.

5. A window frame light hanger device as set forth in claim 1 wherein three perforated line means are formed along predetermined lengths of said window frame light hanger device for enabling manual separation of said elongate strip, as desired.

* * * * *